United States Patent [19]

Sharp

[11] 4,072,079

[45] Feb. 7, 1978

[54] APPARATUS AND METHOD FOR MODIFYING A MUSICAL TONE TO PRODUCE CELESTE AND OTHER EFFECTS

[75] Inventor: Paul H. Sharp, South Pasadena, Calif.

[73] Assignee: CBS Inc., New York, N.Y.

[21] Appl. No.: 713,008

[22] Filed: Aug. 9, 1976

[51] Int. Cl.[2] ..... G10H 1/04

[52] U.S. Cl. ..... 84/1.24; 84/1.25

[58] Field of Search ..... 84/1.01, 1.24, 1.25, 84/DIG. 4, DIG. 20; 179/1 J; 331/45, 111, 178

[56] References Cited

U.S. PATENT DOCUMENTS

| | | | |
|---|---|---|---|
| 3,467,759 | 9/1969 | Campbell | 84/1.25 |
| 3,629,484 | 12/1971 | Suzuki | 84/1.25 |
| 3,719,782 | 3/1973 | Barnum | 84/1.24 |
| 3,749,837 | 7/1973 | Doughty | 179/1 J |
| 3,833,752 | 9/1974 | Van der Koon | 84/1.24 |
| 3,866,505 | 2/1975 | Adachi | 84/1.24 |
| 3,886,835 | 6/1975 | Peterson | 84/1.24 |
| 3,920,905 | 11/1975 | Sharp | 179/1 J |
| 3,973,462 | 8/1976 | Uchitama | 84/1.25 |
| 3,979,991 | 9/1976 | Kalamoto | 84/1.25 |

*Primary Examiner*—Robert K. Schaefer
*Assistant Examiner*—Vit W. Miska
*Attorney, Agent, or Firm*—Spencer E. Olson

[57] ABSTRACT

A signal animation system for an electric organ or other electrical musical instrument which utilizes frequency-proportional detuning wherein the percentage detuning is progressive and uniform, to provide celeste and other musical effects. Detuning is accomplished by a shift register through which sampled electrical representations of an input tone signal are shifted progressively through the register from the input to the output, which delays the signal. The trigger pulses which time the shifting function are frequency-modulated in a manner such that the period of the trigger pulses, rather than their frequency is proportional to a control voltage supplied to the trigger pulse generator. In a system for producing celeste animation, a shift register in each of two channels are controlled to progressively and uniformly phase-shift the musical signal in opposite directions simultaneously on a slow cyclical basis, and to produce abrupt reversal of the direction of phase shift of the two signals substantially simultaneously so as to provide two input signals one of which is slightly musically flat and the other slightly musically sharp for substantially identical periods at the end of which the two signals are abruptly reversed so that the first becomes sharp and the other flat. This cycle is repeated as long as a note is held, and when the two signals are acoustically combined, a very pleasing celeste is produced.

In another embodiment, a shift register and modulator is provided in only one of two parallel sound channels which progressively and uniformly phase shifts the musical signal in opposite directions on a slow cyclical basis and produces an abrupt reversal of direction of the phase shift so as to provide an output signal which is alternately slightly sharp and slightly flat for substantially identical periods. When this output signal is acoustically combined with the unmodified tone signal, a musically acceptable celeste effect is produced.

14 Claims, 10 Drawing Figures

APPARATUS AND METHOD FOR MODIFYING A MUSICAL TONE TO PRODUCE CELESTE AND OTHER EFFECTS

BACKGROUND OF THE INVENTION

This invention relates generally to methods and apparatus for modifying musical tones to achieve desired musical effects, and is more particularly concerned with modifying electrical tone signals in electrical musical instruments such as those of the organ type to produce celeste and other musical effects.

Celeste is the effect produced by playing two or more closely tuned tones together. In a pipe organ, celeste may be produced by sounding together sets of pipes which are naturally or purposely tuned slightly flat and slightly sharp, so that their sounds randomly move into and out of phase, with the true frequency of the note represented by the key played by the organist. Celeste therefore has slow "beating" associated with it, depending on the frequency spread between the tones involved; that is, the extent to which they are out of tune as compared to the reference note.

Various attempts have been made to utilize electrical phasing circuits to modify tone signals to produce chorus or celeste effects. A system described in Leslie, U.S. Pat. No. 3,372,225 utilizes rotary electrostatic devices for producing celeste or chorus effects. However, in this system the beat rates between the signals in two auxiliary electric-acoustic channels are constantly varying, and the same beat rate is applied to the whole musical instrument. The resultant sound is thus an undulating, varying sound, whereas in true celeste the beat frequency should remain constant throughout the period of time the note is played.

U.S. Pat. No. 3,489,843 describes apparatus for producing celeste animation in music wherein an electrical tone signal, or mixed signals, corresponding to the musical tone or tones desired to be modified, is passed through an artificial electrical transmission line, such as an audio frequency delay line, and a pair of scanning members in effect scan the delay line in a cyclic to and fro manner in such a way that as one scanning member is scanning the line in one direction, the other scanning mamber is scanning the line at the same speed in the opposite direction. The scanning of the artificial transmission line in one direction by a scanning member results in the production of a signal on the scanning member having a frequency $f_1$ higher than that of the input signal, and scanning the line in the opposite direction by a second scanning member results in the production of a signal on the second scanning member having a frequency $f_2$ lower than that of the input signal. The scanning members reverse their scanning direction at the ends of the artificial transmission line substantially simultaneously, so that when the signal produced on one scanning member changes from frequency $f_1$ to frequency $f_2$, the signal produced on the other scanning member changes from frequency $f_2$ to frequency $f_1$, such changes in frequency being effected abruptly. The result is the production of two substantially continuous new frequencies, $f_1$ and $f_2$, from one given input signal frequency.

The signals of alternately higher and lower frequency which are picked up by the two scanning members are preferably reproduced through separate loud speakers for converting the electrical signals into sounds.

Although this system is theoretically capable of producing acceptable celeste if the reversals of direction of scanning do not occur too frequently, there is a perceptible discontinuity in the output signals upon reversal, and its commercial implementation, which had a relatively short delay, did not produce particularly good celeste. Moreover, the apparatus is electro-mechanical in character, the elements of the artificial transmission line are bulky and relatively costly, making it somewhat undesirable for use in modern electric organs which are substantially all-electronic and implemented more and more with compact and increasingly less expensive integrated circuits. Although electronically variable delay lines are known and utilized in tone-modifying systems, since the operation of the system described in U.S. Pat. No. 3,489,843 depends for its operation on the simultaneous scanning of a fixed delay line in opposite directions, an electronically variable delay line cannot be directly substituted for the described combination of a fixed audio delay line and a system of stationary capacitor plates and a pair of movable scanning members, in the form of capacitor plates, mounted at the ends of a rotatable arm.

Known electronically variable delay lines are utilized in the tone-modifying system described in Doughty U.S. Pat. No. 3,749,837, wherein the delay line may take the form of a "bucket-brigade" analog shift register through which electrical representations of the magnitude of an input tone signal are periodically sampled, stored and shifted progressively from the input to the output of the shift register, thereby to delay the signal. The trigger pulses which time the sampling and shifting functions are frequency modulated by a low frequency-modulating signal to vary the time delay imposed, thus effecting a frequency modulation of the delayed input tone at the output of the shift register. If a msuical tone of given frequency is applied to the input of the Doughty system, and the frequency appearing at the output of the device measured as the clock frequency is changed, a certain amount of detuning, quite suitable for vibrato and tremolo purposes, results. The pitch of the output signal goes up and down as the clock frequency is modulated, depending on whether the clock frequency is above or below an average frequency. Thus, the Doughty device provides a relatively simple way of producing frequency-proportional vibrato. However, when it is attempted to so modulate the clock that the output frequency is detuned a constant percentage from the input frequency, the condition necessary to produce the celeste effect, it has been found that this could be accomplished only with an extremely complex modulating waveform. As a practical matter, oscillators conventionally employed as clock generators are usually of the voltage-controlled type, and when such an oscillator is used to modulate the clock frequency of a "bucket-brigade" shift register, it has been found that a given change in amplitude of the control voltage produces a much larger change in output frequency at the lower clock frequencies than at higher clock frequencies; that is, at the higher clock frequencies, less detuning for a given change in control voltage is achieved than at the lower clock frequencies. Thus, in order to produce a celeste effect, the waveform of the clock modulating signal would have to be such as to modulate the clock at a rate which increases rapidly as the clock frequency increases; to achieve this result, the modulating waveform would have to be of complex exponential shape, one very difficult to generate and to reproduce in practice.

An object of the present invention is to provide an improved, all-electronic system for modifying an electrical tone signal to produce celeste and other musical effects.

SUMMARY OF THE INVENTION

In accordance with the present invention, animation of sounds initially available in the form of electrical signals is achieved by frequency-proportional detuning of the electrical tone signal in a progressive and uniform manner. Detuning is accomplished by an electronically variable delay line, such as a shift register, through which sampled electrical representations of the tone signal are shifted progressively to produce at the output a delayed version of the input tone signal. The trigger pulses which time the sampling and shifting functions are frequency-modulated by a trigger pulse generator which generates a train of pulses the period of which is proportional to an applied control voltage, whereby the amount of detuning is determined by the rate of change or, slope, of the control voltage.

In a system for producing celeste animation, two such shift register delay lines, one in each of two channels, are controlled by a common clock oscillator and progressively and uniformly shift the frequency of a tone signal applied to both channels in opposite directions simultaneously on a slow cyclical basis and produce abrupt reversal of the direction of frequency change of the two signals substantially simultaneously so as to provide two output signals one of which is musically flat and the other slightly musically sharp for substantially identical periods determined by the period of the control voltage, at the end of which the two signals are abruptly reversed so that the first becomes sharp and the other flat. A control voltage for the clock oscillator of triangular waveform having ramps of predetermined slope causes the frequency of the applied tone signal to be shifted by a uniform amount above and below the frequency of the tone signal throughout the positive- and negative-going ramps, respectively, of the control voltage. This cycle is repeated as long as a note is held, and when the two output signals are reproduced and acoustically combined, the celeste effect is produced.

In another system for producing the celeste effect, a shift register and clock oscillator of the kind described above is provided in only one of two parallel sound channels, the shift register being operative to progressively and uniformly shift the frequency of the applied musical tone is opposite directions on a slow cyclical basis and to produce an abrupt reversal of the direction of the frequency change so as to provide an output signal which is alternately slightly sharp and slightly flat for substantially identical periods determined by the period of the control signal. When the thus-modified tone signal is acoustically combined with the reproduced unmodified tone signal, a musically acceptable celeste is produced.

An important advantage of using a clock oscillator in which the period of its output pulses rather than its frequency is proportional to an applied control voltage is that it enables one to prodict the effect that a change in the waveform (e.g., its frequency, slope, or amplitude) of the control voltage applied to the clock oscillator will have on the output signal from the shift register delay line. Stated in the converse, it enables one to control the effect one wants in the modified tone signal and to design a control voltage signal for application to the clock oscillator to achieve that effect. Thus, while a triangular waveform signal having ramps of predetermined slope produce the desired detuning for the celeste effect in the two-channel systems described above, control voltages of other wave forms can be used to modulate the trigger pulses that control the sampling and shifting of the shift register in one- or two-channel systems to produce predictable other musical effects. For example, a single shift register delay line in a one-channel system is capable of producing a variety of musical effects depending on the nature of the control voltage applied to the clock oscillator. Use of a sine wave or triangular wave control voltage produces a vibrato effect, and waveforms of special shapes whould produce other musical effects. Stereophonic vibrato can be produced in a two-channel system each channel of which includes a shift register delay line the clock oscillators for which are controlled by control signals differing in phase by a selected angle, such as 90°, the amount of phase difference enabling a variety of effects to be achieved.

DESCRIPTION OF THE DRAWINGS

Other objects and features of the invention will become apparent, and its construction and operation better understood from the following detailed description taken in conjunction with the accompanying drawings in which.

DESCRIPTION OF THE PREFERRED EMBODIMENT

Figure 1:
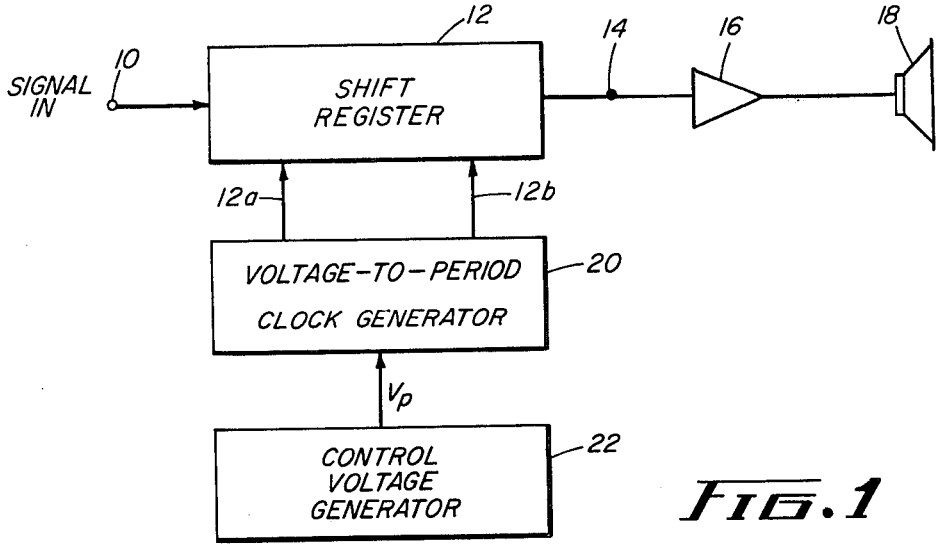
FIG. 1 is a block diagram illustrating a single channel device embodying the principles of the invention.

Referring now to FIG. 1 for a description of the general character of the invention, the apparatus there shown comprises a musical tone-modifying device which includes an input terminal 10 which receives an analog signal representative of a musical tone from a suitable source, such as an electronic organ, a shift register delay device 12 for controllably detuning the input signal, and an output terminal 14. The tone modifier is normally used in an audio signal processing channel which further includes a suitable power amplifier 16 and a sound-reproducing device, for example, a loudspeaker 18. The desired modulation of the tone signal is achieved with a shift register through which sampled electrical representations of the amplitude of the input signal are shifted progressively from the input to the output, thus delaying the signal. The timing of the shifting function of the shift register 12 is controlled by trigger pulses from a clock oscillator 20, which are frequency-modulated under control of a signal generated by a control voltage generator 22, so as to vary the time delay imposed and thereby to cause frequency modulation of the delayed input tone signal appearing at the output terminal 14. The shift register 12 may be of the type described in the aforementioned Doughty U.S. Pat. No. 3,749,837, a "bucket-brigade" form of which is commercially available and the construction and operation of which are described in the *IEEE Journal of Solid State Circuits* June, 1969, in an article by F. L. J. Sangster and K. Teer, entitled "Bucket-Brigade Electronics-New Possibilities for Delay-Time Conversion and Scanning".

Alternatively, the shift register 12 may be a digital shift register provided with analog-to-digital and digital-to-analog converters of known form, a parallel implementation of which is also described in the Doughty patent. A system utilizing parallel-to-serial conversion, and one long delay line, may also be used. The memory in either of these embodiments can be magnetic bubble memories, this from of memory being particularly suitable for achieving the long delay in a parallel-to-serial system. It is intended that the term "shift register" as used in the specification and claims shall encompass all such possible implementations.

Although superficially similar to FIG. 1 of the Doughty patent, the system illustrated in FIG. 1 has the important difference that the period of the trigger pulses which control the timing of the shifting function of the shift register is proportional to a control voltage applied to the clock oscillator. Stated another way, instead of using a voltage-controlled oscillator of a kind disclosed by Doughty and conventionally used as clock generators, whose frequency is proportional to an applied control voltage, the clock generator 20 generates a train of trigger pulses the period of which is proportional to an applied control voltage. Consequently, the frequency of the trigger pulses is inversely proportional to the control voltage. The use in the arrangement of FIG. 1 of a voltage-to-period clock generator, instead of the conventionally used voltage-to-frequency clock generator, provides the unexpected important advantage that the percentage change of the frequency of the output signal as compared to the frequency of the input signal is directly related to the rate of change, or slope, of the control voltage applied to the clock generator. For example, a ramp voltage of fixed slope applied to the clock generator provides an output signal that is detuned by a fixed percentage from the input frequency which does not change during the period of the ramp. On the other hand, if a signal having a triangular waveform, the slope of which reverses as its goes through each cycle, is used as the control voltage for the clock generator, the frequency of the output signal is successively and uniformly shifted in opposite directions by equal amounts from the frequency of the input signal on a cyclical basis determined by the frequency of the triangular waveform signal, with an abrupt reversal of the direction of frequency shift at successive half cycles. Thus, the output signal is alternately slightly sharp and slightly flat for substantially identical periods relative to the input tone signal. Knowing that the percentage change of the output frequency as compared to the input frequency is directly related to the rate of change of the control voltage, it is possible accurately to predict the frequency modulation of the output signal that will occur when various wave shapes are used for the control voltage; this predictability, in turn, enables the design of systems for producing a variety of musical effects, the detuning characteristics necessary for the production of which are generally known by ones skilled in the electrical musical instruments art.

Figure 2:
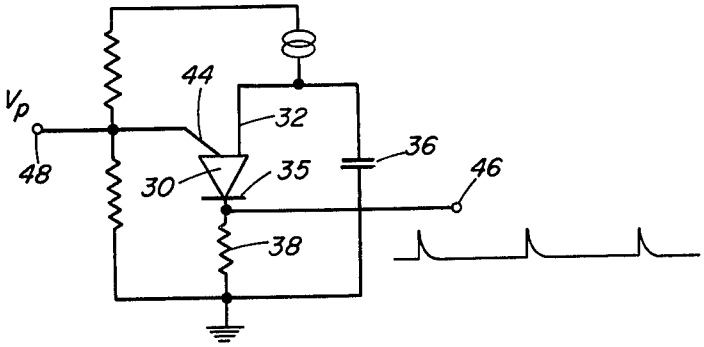
FIG. 2 is a circuit diagram of a voltage-to-period clock pulse generator, and FIGS. 2A an 2B are waveform diagrams used to illustrate its operation.

FIG. 2 is a schematic circuit diagram of a voltage-to-period clock generator 20 suitable for producing output pulses whose period is proportional to an applied control voltage. The clock generator includes a programmable unijunction transistor (PUT) 30 the anode 32 of which is connected to one terminal of a current source 34 and to one terminal of a capacitor 36, and the cathode 35 of which is connected by a resistor 38 to the other terminal of capacitor 36. The program of the PUT oscillator is determined by the ratio of the resistances of a pair of resistors 40 and 42 connected in series between the other terminal of current source 34 and the junction of resistor 34 and capacitor 36, the junction between resistors 40 and 42 being connected to the program electrode 44 of the PUT. The described circuit is a well-known and simple relaxation oscillator the frequency of which in normal usage is proportional to the current from current source 34. As background for an understanding of how this known oscillator is modified to achieve the objectives of the present invention, its normal operation will first be described.

Figure 2A:
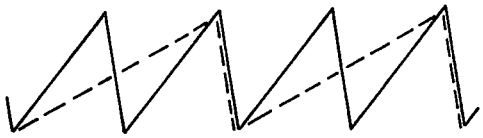

The programmable unijunction transistor has a very high impedance between its anode 32 and cathode 35 until such time as the voltage at the anode reaches a preset program voltage, determined by the ratio of the resistances of resistor 40 and 42, whereupon the device goes into a high conduction mode which continues until the current through the PUT falls below a certain holding value. When the current goes below the holding value, the PUT ceases to conduct and returns to its high impedance state. Assuming that initially the capacitor 36 has zero voltage across it and a current commences to flow from current source 34, the capacitor 36 will charge up at a constant rate producing at the anode 32 the ramp voltage shown in solid line in FIG. 2A. When the capacitor has charged to the point at which the voltage of the anode 32 reaches the program voltage $V_p$, the PUT goes into its high conduction mode, the capacitor 36 is rapidly discharged through the PUT and resistor 38, thereby to produce a pulse at an output terminal 46 connected to the cathode. Insofar as the voltage at the anode 32 is concerned, however, the device is a simple sawtooth generator, the voltage rising gradually to the conduction voltage $V_p$ and then dropping rapidly to ground potential. If the value of the current from source 34 were doubled, for example, from the value that produced the solid line waveform in FIG. 2A, then the voltage on capacitor 36 would build up to the conduction voltage $V_p$ twice as fast, causing a doubling in the frequency of the output pulses at terminal 46 over what it was before. Conversely, if the magnitude of the current is halved, it would take twice as long for capacitor 36 to charge up to the program voltage $V_p$, with the consequence that the frequency of the output pulses would also be halved; the latter condition is shown by the dotted line sawtooth waveform in FIG. 2A. Thus, it is seen that the frequency of the pulses produced at the output terminal 46 is proportional to the control current from source 34. It will be noted from FIG. 2A that the slope of the charging curve of capacitor 36 changes with the magnitude of the current from source 34; that is, at higher current values, the capacitor charges more quickly such that the slope of the charging curve is steeper than it is at a lower current value. Thus, the circuit of FIG. 2, in its usual application, is a simple voltage-to-frequency converter.

Important to the achievement of the objectives of the present invention was the recognition by applicant that the PUT oscillator of FIG. 2 can be modified to function as a voltage-to-period converter instead of a voltage-to-frequency converter. To be operative as a voltage-to-period clock generator, the current from source 34 is set at a predetermined value suitable to a particular application which, for purposes of illustration, may be of the value that produces the solid-line sawtooth waveform shown in FIG. 2B; that is, a current value at which the time to charge the capacitor 36 up to the program voltage $V_p$ is the same as in the example described in the previous paragraph. The program voltage, $V_p$, is determined as before by the ratio of the resistances of resistors 40 and 42 and is set at an initial condition appropriate to the preset value of current from source 34. For example, the ratio of the resistances of resistors 40 and 42 and the value of the current from source 34 may be set such that the voltage across capacitor 36 builds up until a ten-volt program voltage is reached, at which the PUT fires and discharges the capacitor. If, now the program voltage $V_p$ is cut in half (i.e., reduced to five volts from the previously assumed firing voltage of ten volts) as by application of a control voltage to a terminal 48 connected to the junction of resistors 40 and 42, but without changing the value of the current from source 34, the voltage across capacitor 36 will charge to only half of its original value before the PUT goes into its high conduction mode to discharge the capacitor. As illustrated by the dotted line waveform in FIG. 2B, when the magnitude of the program voltage $V_p$ is cut in half, the frequency of the sawtooth waveform at the anode 32 is doubled. Since the frequency of any waveform signal is inversely proportional to its period, the period of the output pulses at terminal 46 is cut in half when the program voltage is cut in half from some initial value. Thus, the period of the output pulses generated at terminal 46 is directly proportional to the program voltage $V_p$.

Figure 2B:
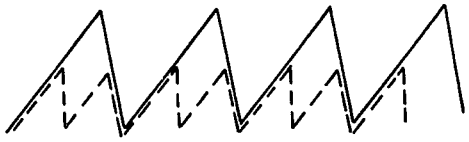

It is important to note in FIG. 2B that although the frequency of the dotted-line sawtooth waveform is twice that of the solid-line waveform, the slope of the ascending ramp is the same in both cases. To again characterize the differency between the operation of the circuit of FIG. 2 as a voltage-to-frequency clock generator and a voltage-to-period clock generator, instead of changing the value of the current from source 34 to make the capacitor charge more rapidly or more slowly to change the frequency of the output pulses (which also results in a change in the slope of the charging characteristics), in the voltage-to-period operation a constant current is applied to the capacitor and the program voltage is varied to control the time of charging of the capacitor before the PUT fires to produce an output pulse. This seemingly small change in the mode of operation of the circuit causes the period of the output pulses to be directly related to the program voltage, $V_p$; the frequency of the output pulses is also changed, of course, but in a reciprocal fashion. Because the period of the output pulses is directly related to the program voltage, when the pulses are utilized to control the shifting of sampled signal information in a shift register, they produce a percentage change of the frequency of the signal at the output of the shift register as compared to the frequency of a signal applied to the input of the shift register is produced which is directly related to the rate of change, or slope, of the control voltage applied to terminal 48.

How the slope of the control signal applied to terminal 48 of the clock oscillator 20 affects the frequency change at the output of the shift register 12 in the system of FIG. 1 will be better understood from the following brief description of the operation of a "ducket-brigade" type of analog shift register. The shift register 12 may be a type PCA 350 integrated circuit bucket-brigade shift register manufactured by ITT Semiconductors which includes between its input and output terminals 185 capacitors separated from one another by analog switching circuitry, and connected in cascade. This device samples the tone signal voltage applied to its input terminal at a rate corresponding to the frequency of clock signals applied to its clocking terminals **12*a* and 12B. With each set of clock pulses supplied to the clocking terminals, the charge that originates on the input terminal is transmitted down the line, stage be stage, toward the output terminal, so that after 185 clock pulses the charge will be delivered to the output terminal of the shift register. Thus, the shift register produces a time delay between the input and output of the device corresponding to the product of the inverse of the clock frequency multiplied by the number of stage in the shift register. Theoretically, the minimum clock frequency is two times greater than the highest audio frequency of interest in the tone signal to be modified, thus indicating a nominal clock frequency of at least 20 KHz, although normally, depending upon the type of shift register used, the clock frequency is somewhat higher. If the frequency of the clock pulses applied to the clock terminal 12*a* and 12*b* is constant, the analog signal produced at the output terminal 14 by converting the electrical representations of the stored values which emerge from the shift register to analog differs from the input signal at terminal 10** only in the respect that it is delayed by the aforementioned time delay interval. It will be appreciated that if the shift register has a relatively small number of stages the clock frequency must be low in order to achieve a given delay, whereas if the shift register has a larger number of storage elements a higher clock frequency can be used to obtain a given delay.

However, when the frequency of the clock pulses applied to the clock terminals is varied under control of a modulator such as by the control voltage generator 22 controlling the clock oscillator 20, the electrical representations which emerge from the shift register 12 will be at a rate different from that at which they were sampled and stored, the difference being due to the fact that the sampling frequency has changed over the interval which it takes for the stored values to proceed through the shift register. Thus, the analog signal which is formed at the output of the shift register will be either expanded or compressed on a time basis relative to the waveform of the input signal, thus resulting in an apparent frequency shift in the output signal. If, as taught by Doughty, the frequency of the clock pulses is controlled in response to a low frequency sine wave control voltage, a given change in the amplitude of the control voltage causes a much larger change in output frequency at the low end of the audio frequency range of interest than at the higher frequencies; that is, at the high end of the audio range, less detuning for a given change in control voltage is obtained than at the lower end of the audio frequency range.

In the present system, on the other hand, wherein the period rather than the frequency of the clock pulses applied to the clock terminals 12*a* and 12*b* is determined by the modulating voltage applied to the clock generator, the apparent frequency shift in the output signal as a percentage of the input frequency is directly proportional to the rate of change, or slope, of the modulating voltage. Thus, if a ramp voltage of given slope (i.e., a voltage having a constant rate of change) is utilized to control the period of the clock generator, the percentage change of the output frequency as compared to the input frequency is constant throughout the period of the ramp voltage; that is, the output signal is detuned from the frequency of the input tone signal by a fixed amount determined by the slope of the control voltage applied to the voltage-to-period clock generator 20. Similarly, the period of the clock pulses may be controlled by a sinusoidal modulating voltage applied to the clock generator; in this case, however, the slope of the control voltage is constantly varying, thereby causing the period of the clock pulses to also vary sinusoidally, which would cause frequency-proportional vibrato on the output signal from the shift register.

The predictability of the frequency modulation that will be obtained in response to application to the voltage-to-period clock of a control voltage of particular wave shape makes the device of FIG. 1 particularly useful for the production of a variety of musical effects. Designers of electronic organs have long attempted to simulate celeste, the effect produced by playing two or more closely tuned tones together. In an electronic organ, celeste may be produced by sounding together two sets of tone generators which are tuned slightly flat and slightly sharp, so that the true frequency of the note represented by the key played by the organist lies between the frequencies of the two tones the resulting "beating" remains constant throughout the time a given note is played. Since each note is somewhat different from all others, the musical effect is an apparent randomness caused by the fact that each note has a different beat rate than every other note, but with the beat frequency of each individual note remaining constant as long as that note is played. This result is quite well simulated by the system shown in FIG. 3, wherein an analog signal representing a musical tone from a source indicated by terminal 50 is connected to both of two audio channels 52 and 54, the former containing only a suitable power amplifier 56 and a sound reproducing device, such as a loudspeaker 58, and the channel 54 including in addition to a power amplifier 60 and a loudspeaker 62 the device of FIG. 1 for controllably detuning the input tone signal. The voltage-to-period clock 20, constructed in accordance with the diagram of FIG. 2 for generating trigger pulses for application to the clock terminals 12*a* and 12*b* of the analog shift register 12 is controlled by a control voltage of triangular waveform shown at 64, a signal which is easily and reproducibly generated. This signal, the slope of which is constant on both its ascending and descending ramps, is produced by a triangular waveform generator 66 of known configuration, a typical implementation of which will be subsequently described in connection with FIG. 4.

It will be appreciated from the above discussion of FIGS. 1 and 2 that during the period that the ramp of waveform 64 is ascending, the output signal from the shift register 12 is tuned slightly sharp with respect to the tone signal applied at input terminal 50, and when the apex of the triangular waveform is reached and reverses, the output signal from the shift register is tuned slightly flat, by a substantially equal amount. The frequency of the triangular waveform 64 is in a range to cause the frequency of the input tone signal waveform 64 to be successively and uniformly shifted in opposite directions on a slow cyclical basis and provide for abrupt reversal of the direction of frequency shift so as to provide an output signal which is slightly musically flat and slightly musically sharp for substantially identical periods, this cycle being repeated endlessly as long as a note is held. The amount of detuning is determined by the slope, or rate of change, of the ascending and descending ramps of the triangular waveform signal. For example, if it is desired to have a celeste beat of 2 Hz with a 1 KHz tone, the slope of the ramps of waveform 64 would be chosen to detune the input signal to 1,002 Hz during the ascending portion of the control waveform and upon reversal of direction, to detune the input signal to 998 Hz, so as to be two cycles flat with respect to the input tone signal. As long as the frequency difference remains constant until there is a reversal in direction of the control voltage waveform, the listener hears only a pleasant, smooth tone that goes from sharp to flat and back again at the frequency of the control signal. When the frequency-modulated signal, which is alternately tuned sharp and flat by a substantially constant amount, for substantially equal periods, is acoustically combined with the unmodified signal transmitted by channel 52, a beat note is generated the frequency of which remains constant regardless of whether the pitch of the modified signal is above or below the pitch of the input signal. Although a very sensitive listener might sense that the tone coming from loudspeaker 62 is sharp part of the time and flat part of the time, the transition from sharp to flat is quite unnoticeable, and the musical effect is much like that of celeste.

The perceptibility of the transitions from sharp to flat and back again is strongly dependent on the time that elapses between reversals of the direction of detuning; for example, if the control voltage reverses direction ten times a second, the transitions from sharp to flat are more noticeable than when the reversals occur at a slower rate. Since it is the slope of the control waveform that determines the amount of detuning, one of the design compromises is between the length of the shift register (i.e., the number of stages or storage elements) and the frequency of the control signal. That is, for the same amount of frequency deviation, preferably 2 Hz for celeste, a delay line of given length and a triangular wave form of given slope could be used, or, instead, a shift register having twice as many stages and a control voltage of triangular waveform, the ramps of which have a slope which is half that of the former, could be used. If the latter compromise is chosen, this would mean that it would take twice as long to reach one extreme or the other of the allowable clock frequency before reversing direction of detuning, meaning that the repetitive phenomenon of shifting from sharp to flat to sharp would occur less frequently.

Figure 4:
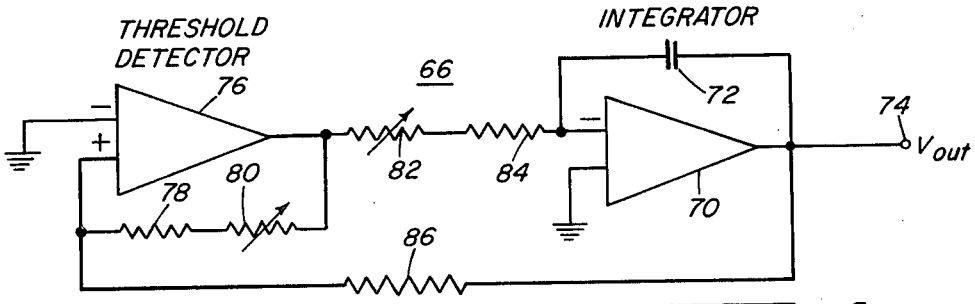
FIG. 4 is a circuit diagram of a circuit for generating a triangular waveform voltage.
Figure 3:
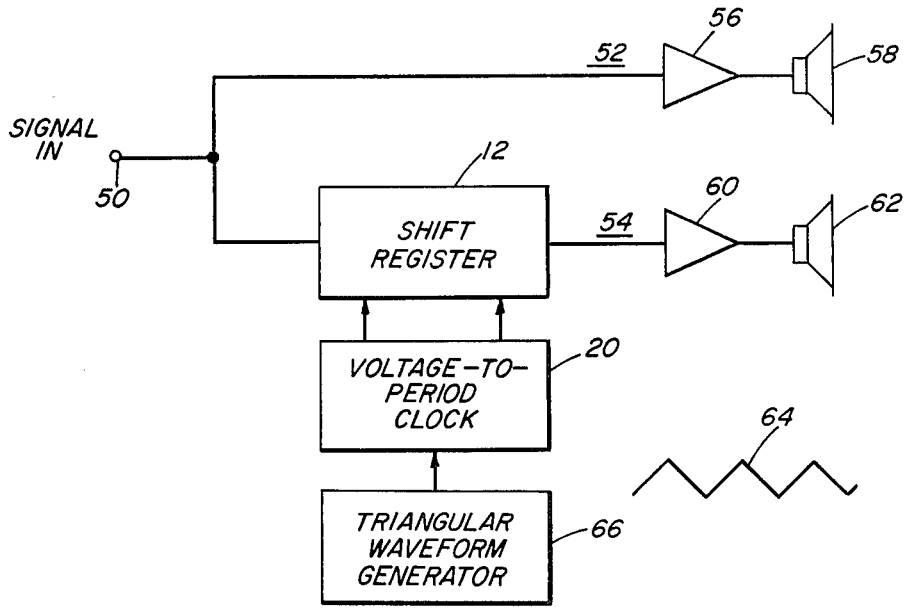
FIG. 3 is a block diagram of one system utilizing the tone-modifying device of FIG. 1 for producing celeste effects.

In FIG. 4 there is shown a variable frequency triangular waveform generator of known construction which is suitable for use as the waveform generator 66 in the FIG. 3 system. The generator embodies an integrator as a ramp generator and a threshold detector with hysteresis as a reset circuit. The integrator is essentially a low-pass filter having a frequency response decreasing at 6dB per octave and comprises an operational amplifier 70 having a capacitor 72 connected between its output terminal 74 and its inverting input terminal. The threshold detector is similar to a Schmitt trigger in that it is a latch circuit with a large dead zone, this function being implemented by using positive feedback around an operational amplifier 76. When the amplifier output is in either the positive or negative saturated state, the positive feedback network consisting of a resistor 78 and a variable resistor 80 connected between the output terminal of the amplifier and the non-inverting input terminal provides a voltage at the non-inverting input terminal which is determined by the attenuation of the feedback loop and the saturation voltage of the amplifier. To cause the amplifier to change states, the voltage at the input of the amplifier must be caused to change polarity by an amount in excess of the amplifier input offset voltage. When this is done, amplifier 76 saturates in the opposite direction and remains in that state until the voltage at its input again reverses.

The complete circuit operation may be understood by examining the operation with the output of the threshold detector in the positive state. The positive saturation voltage is applied to the integrator summing junction through the series combination of variable resistor 82 and resistor 84, causing a current to flow. The integrator then generates a negative-going ramp having a slope determined by capacitor 72 until its output voltage equals the negative trip point of the threshold detector, whereupon the detector changes to the negative output state and supplies a negative current at the integrator summing point. The integrator now generates a positive-going ramp of the same slope until its output voltage equals the positive trip point of the threshold detector whereupon the detector again changes its output state and the cycle repeats. The frequency of the triangular waveform generator is determined by variable resistor 82, the resistor 84 and capacitor 72, and the positive and negative saturation voltages of amplifier 76. The amplitude of the output waveform is determined by the ratio of the resistance of resistor 86 to the resistance of the combination of resistors 78 and 80, and the threshold detector saturation voltages. The slopes of the positive and negative ramps are equal, and positive and negative peaks are equal if the detector has equal positive and negative saturation voltages. It will be understood that the output terminal 74 of the sawtooth waveform generator would be connected to the control terminal 48 of the trigger pulse generator 20 of FIG. 2 to control the period of the trigger pulses developed across resistor 38.

Figure 5:
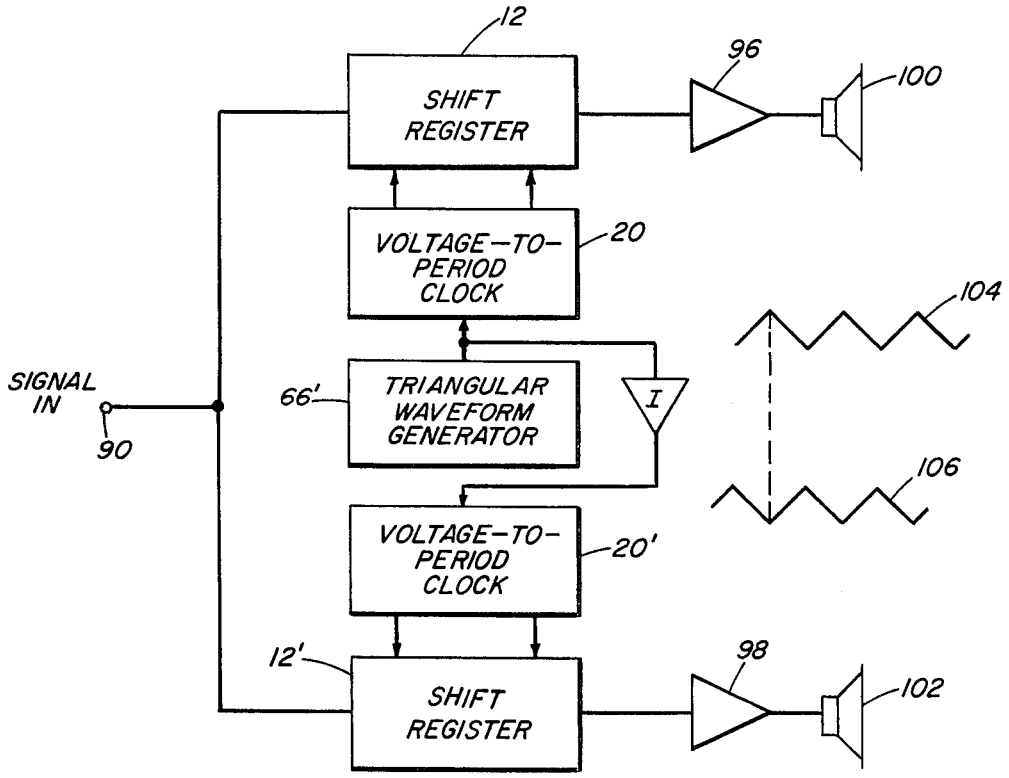
FIG. 5 is a block diagram of another system for producing celeste effects.

FIG. 5 is a block diagram of an alternative to and which produces a celeste effect superior to that provided by the system of FIG. 3. In this system, a tone signal from a source represented by an input terminal 90 is applied to both of two audio sound channels 92 and 94, both of which include a shift register 12 of the character described in connection with FIG. 1 and respectively including power amplifiers 96 and 98 and loudspeakers 100 and 102. The shift registers 12 and 12' are controlled by separate voltage-to-period clock generators 20 and 20', respectively, the period of the pulses generated by both being controlled by triangular waveform voltages produced by a generator 66', which may be of the configuration illustrated in FIG. 4. The signal generator 66' produces a triangular waveform voltage depicted at 104, which is coupled to and controls the clock generator 20 associated with shift register 12. The signal 104 is also applied to and inverted by an inverter 75 to produce a triangular signal 106, which is 180° out of phase with respect to signal 104, and is applied to the clock generator 20' associated with shift register 12'.

Recalling the operation of the system of FIG. 1, because the clock generator associated with shift register 12' is controlled by a triangular waveform voltage that is 180° out of phase with respect to the control voltage applied to clock generator 20 that controls shift register 12, the tone signal in channel 92 is detuned in a direction opposite to that in which it is detuned in channel 94. That is, during the times that the output signal from the shift register 12 is being tuned sharp, the output signal in the other channel is being tuned flat, and when the control waveform reverses, the signal in channel 92 is tuned flat and in channel 94 it is tuned sharp. Thus, there is always an output signal from both loudspeakers 100 and 102, one sharp and one flat, as compared to the input tone signal, with the sharp and flat signals changing loudspeakers at the frequency of the modulating triangular waveform. Because one signal is always slightly musically sharp and the other slightly musically flat for substantially identical periods at the end of which the two signals are abruptly reversed so that the first becomes sharp and the other flat, a celeste effect is produced when they are acoustically combined, and the pitch wander that may sometimes be perceived with the system of FIG. 3 is essentially eliminated.

Although the description thus far has been directed to the advantages of utilizing a voltage-to-period clock generator for controlling a shift register to produce celeste, because of the predictability of how the output signal from the shift register will be frequency modulated in response to application of a control voltage of particular waveform, it is also useful in the production of other musical effects. For example, by applying a sinusoidal control voltage to the control terminal 48 of the voltage-to-period oscillator 20 in the system of FIG. 1, a one-channel vibrato effect can be produced. Because the percentage deviation of the detuned signal is directly related to the rate of change of the voltage applied to terminal 48, the amplitude of the control voltage will determine the amount of frequency modulation of the output signal. Thus, the system can be varied from where it produces no vibrato to where it creates a deeper and deeper vibrato, simply by changing the amplitude of the sinusoidal control voltage, which can be readily done with a control potentiometer.

Figure 6:
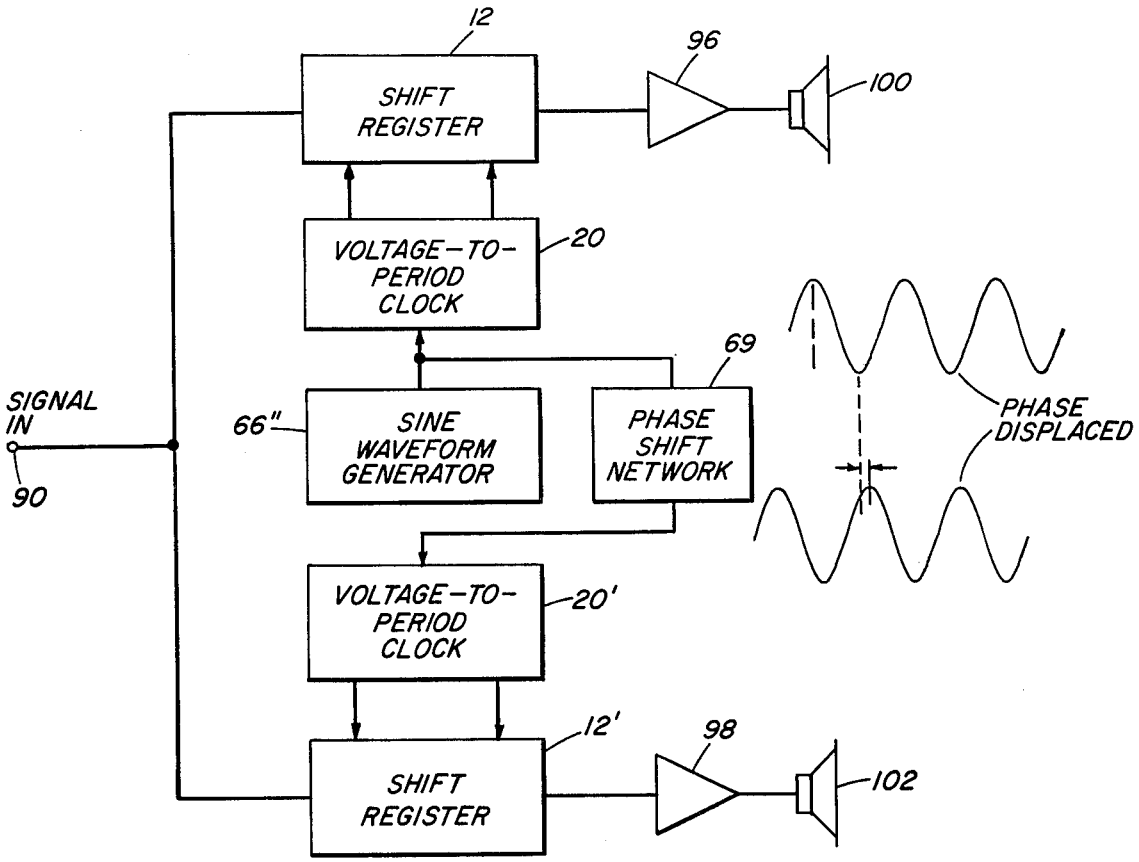
FIG. 6 is a block diagram of a system utilizing the device of FIG. 1 for producing stereophonic vibrato effects.

Sterophonic vibrator can be produced by the system shown in FIG. 6, which is similar in all respects to the system of FIG. 5 except for the control voltage generator which controls the period of the voltage-to-period clock generators 20 and 20'. For the sake of brevity, the parts of the system common to the system illustrated in FIG. 5 have been identified with like reference numerals and will not otherwise be described. In this system, a control voltage generator 66'' produces a sinusoidal voltage which is applied in one phase to the voltage-to-period clock 20 associated with channel 92, and the same sinusoidal voltage after being phase shifted by a predetermined amount by a phase shift network 69, is applied to the control terminal of the voltage-to-period clock 20' associated with channel 94. The phase displacement may be any angle in the range from zero to 180°, a displacement of 90° being particularly suitable for the generation of stereophonic vibrato. As in the case of the single channel vibrato, the percentage deviation of the output signal is readily and predictably controllable by varying the amplitude of the sinusoidal control voltage waveform.

Figure 6A:
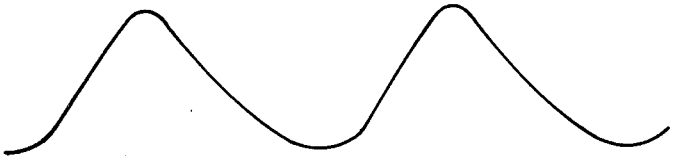
FIG. 6A is a waveform diagram of an alternative control signal useful in the system of FIG. 6.

Musical effects different from that produced by using a sinusoidal control voltage in the system of FIG. 6 can be achieved through use of a non-sinusoidal control signal of the shape shown in FIG. 6A, which has a steeper slope in the positive-going direction than in the other direction. A control voltage of this wave shape applied to the voltage-to-period clocks produce larger excursions in the "sharp" direction than in the "flat" direction, thereby to produce a more "throbby", and more interesting sound than is produced by a sinusoidal waveform. While a particular wave shape is shown in FIG. 6A, the waveform can be tailored to produce the desired ultimate effect on the output signal. Such smooth non-sinusoidal waveform signals can also be used in the single channel system shown in FIG. 1.

Figure 7:
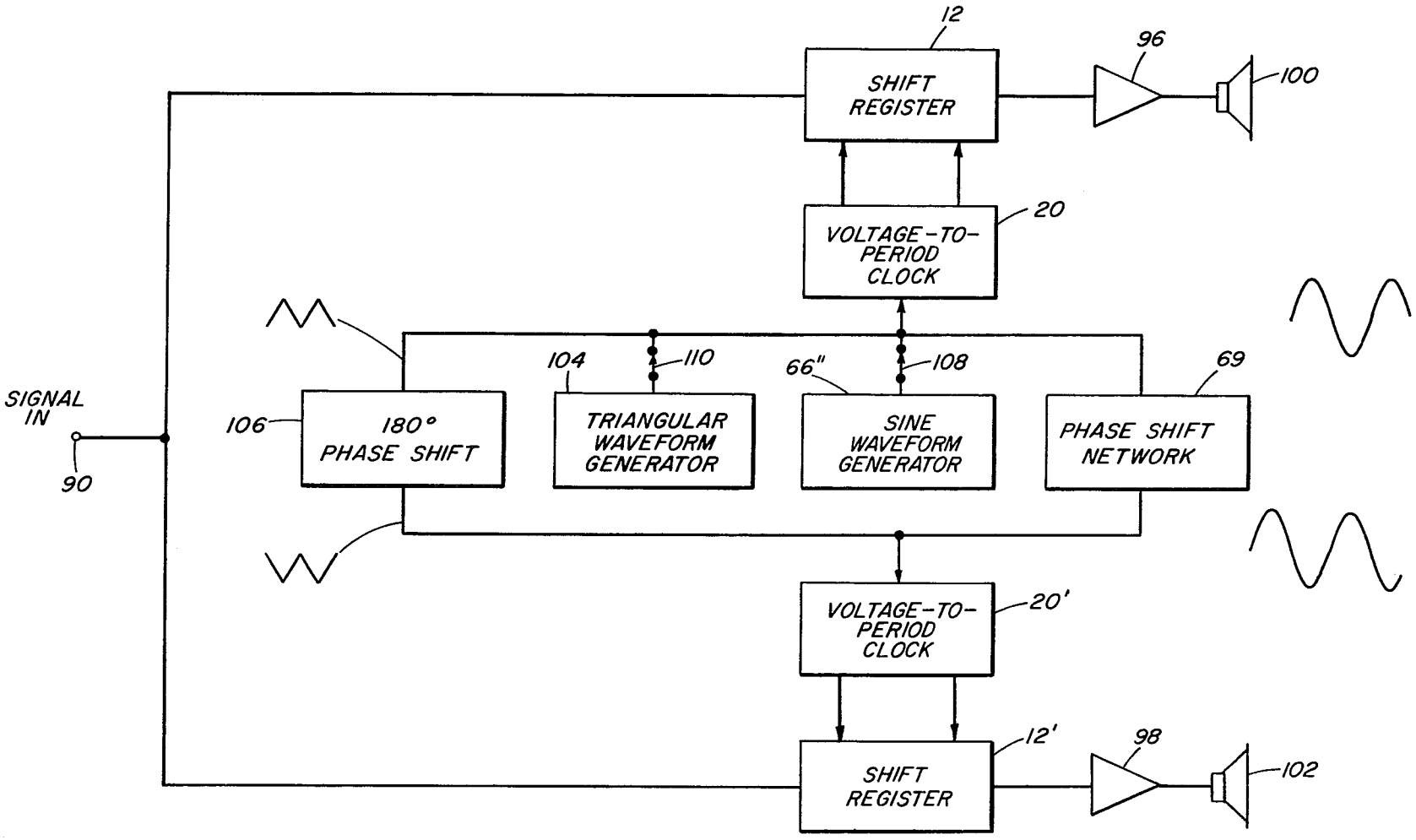
FIG. 7 is a block diagram of a two-channel vibrato-chorus system utilizing the device of FIG. 1.

FIG. 7 illustrates in block diagram form a system capable of producing two-channel vibrato and chorus simultaneously; it is similar in all respects to the system of FIG. 6 except for the addition of a triangular waveform generator 104 which produces a triangular waveform voltage which is applied in one phase to the voltage-to-period clock 20, and after being shifted in phase by 180° by a phase-shift circuit 106 is applied to voltage-to-period clock 20'. The phase-displaced triangular waveform control voltages, which may have a frequency of the order of 0.5 Hz, are combined with the phase-displaced sine waveform control voltages from generator 66'', thereby to produce complex waveform signals for controlling the voltage-to-period clocks 20 and 20'. As in the system of FIG. 5, the triangular waveform control voltage produces two out of tune signals at the two loudspeakers, and the sinusoidal signals, which may have a frequency of about 6 Hz, produce vibrato on the output signals, the combined effect of which is a chorus effect. Alternatively, a waveform differing from a sine wave, such as the waveform shown in FIG. 6A, may be used instead of the sine wave control signal. By providing switches 108 and 110 in the output lines of generators 66'' and 104, either or both of the control signals can be applied to the clocks 20 and 20'.

Although several system applications have been illustrated to show the utility of the tone modifier device according to the invention, it will now be apparent to those skilled in the design of electronic musical instruments that it can be used with advantage in other systems to produce other musical effects. This is so because the use of the voltage-to-period clock to control the frequency of the clock generator enables prediction of the frequency modulation that will appear on the output signal delivered by the shift register in response to application of control voltage waveform of particular shape to the clock generator. In other words, this device enables one to achieve better control over the parameters of the system and to produce the end effect that one wants rather than merely accepting and living with the vagaries of prior art electronic systems in which it was impossible to produce predesigned results.

I claim:

1. In an electric musical instrument, apparatus for electronically modifying sound derived from a source in which the sound is in the form of an audio frequency electrical signal, the combination of:

shift register means having an input terminal connected to receive an audio frequency electrical signal from said source and an output terminal, a first clock generator coupled to said shift register means operative to generate a train of clock pulses the period of which is controllable in direct proportion to a control voltage applied to said clock generator, said clock pulses being applied to said shift register means for controlling the shifting of sampled representations of said audio frequency electrical signal through the shift register means to produce at said output terminal a delayed electrical analog representation of said audio frequency electrical signal, and means for applying a sub-audio frequency control voltage to said first clock generator thereby to vary the period of said train of clock pulses at said sub-audio frequency rate, whereby a delayed frequency-modulated electrical analog representation of said input audio frequency electrical signal differing in frequency therefrom by an amount determined by the rate of change in amplitude of said sub-audio frequency control voltage is produced at said output terminal.

2. Apparatus according to claim 1, wherein said shift register means includes a digital shift register.

3. Apparatus according to claim 1, wherein said shift register means includes an analog shift register of the "bucket brigade" type.

4. Apparatus according to claim 1, wherein said last-mentioned means is a first control voltage generator operative to produce a control voltage having a triangular waveform having ascending and descending ramps of substantially the same absolute predetermined slope and a preselected frequency, whereby the frequency of the delayed electrical representation of the input signal produced at said output terminal is substantially uniformly shifted by a predetermined amount in one direction for one half-cycle of the triangular waveform, and is substantially uniformly shifted by a like amount in the opposite direction during the other half-cycle of the triangular waveform, and means for amplifying and transducing into sound said frequency-modulated signal produced at said output terminal.

5. Apparatus according to claim 4, further comprising:

an audio sound channel connected to receive said input electrical signal and consisting of means for amplifying and transducing into sound said input electrical signal, the transducing means for said frequency-modulated signal and the transducing means for said input electrical signal being arranged to acoustically combine the transduced sound signals for producing a celeste effect.

6. Apparatus according to claim 4, further comprising:

second shift register means as defined in claim 1 connected to also receive the electrical signal from said source for producing at its output terminal a delayed representation of said electrical signal, a second clock generator as defined in claim 1 connected to said second shift register means for controlling the shifting function thereof, means for applying to said second clock generator a control voltage of triangular waveform having the same frequency as the control voltage produced by said control voltage generator and in phase opposition therewith, whereby the frequency of the delayed signal produced at the output terminal of said second shift register means is substantially uniformly shifted in one direction by a predetermined amount in one direction for one-half cycle of the triangular waveform while the frequency of the delayed signal produced at the output terminal of the other shift register is simultaneously uniformly shifted in the opposite direction by the same amount during the same period, said control voltages substantially instantaneously at the termination of said one-half cycle reversing the two directions of uniform frequency shift for a like time interval half-cycle to provide two periodically abruptly terminated and reversed as to direction of frequency shift cyclical uniformly frequency shifted new signals which two frequency shifted new signals are frequency shifted oppositely with respect to each other continuously, and means for separately amplifying and transducing into sound said frequency-modulated signal produced at the output terminal of said second shift register means.

7. Apparatus according to claim 1, wherein said last-mentioned means is a control voltage generator for producing a control voltage having a sinusoidal waveform of frequency in the range of about 3 to 7 Hz and of predetermined amplitude, whereby to produce frequency-proportional vibrato on the delayed electrical representation of the input signal produced at the output terminal of said shift register means.

8. Apparatus according to claim 1, wherein said last-mentioned means is a control voltage generator for producing a control voltage having a smooth non-sinusoidal voltage of frequency in the range of about 3 to 7 Hz and of predetermined amplitude.

9. Apparatus according to claim 7, further comprising:

second shift register means as defined in claim 1 connected to also receive the electrical signal from said source for producing at its output terminal a delayed representation of said electrical signal, a second clock generator as defined in claim 1 connected to said second shift register means for controlling the shifting function thereof, means for applying to said second clock generator a control voltage of sinusoidal waveform of the same frequency as the control voltage produced by said control voltage generator and phase displaced relative thereto by a predetermined phase angle in the range from 0° to 180°, and means for separately amplifying and transducing into sound the frequency-modulated signal produced at the output of said second shift register means, whereby the reproduced signals from the two shift register means when acoustically combined produce stereophonic vibrato.

10. Apparatus according to claim 9, wherein said predetermined phase angle is about 90°.

11. Apparatus according to claim 8, further comprising:

second shift register means as defined in claim 1 connected to also receive the electrical signal from said source for producing at its output terminal a delayed representation of said electrical signal, a second clock generator as defined in claim 1 connected to said second shift register means for controlling the shifting function thereof, means for applying to said second clock generator a control voltage having a smooth non-sinusoidal waveform of the same frequency as the control voltage produced by said control voltage generator and phase displaced relative thereto by a predetermined phase angle in the range from 0° to 180°, and means for separately amplifying and transducing into sound the frequency-modulated signal produced at the output of said second shift register means, whereby the reproduced signals from the two shift register means when acoustically combined produce stereophonic vibrato.

12. Apparatus according to claim 11, wherein said predetermined phase angle is about 90°.

13. Apparatus according to claim 6, further comprising:

means for also applying to said first clock generator a control voltage having a sinusoidal waveform of frequency in the range of about 3 to 7 Hz and of predetermined amplitude, and means for also applying to said second clock generator a control voltage of sinusoidal waveform having the same frequency as that applied to said first clock generator and phase displaced relative thereto by a predetermined phase angle in the range from 0° to 180°, whereby the reproduced signals from the two shift register means when acoustically combined produce vibrato and chorus effects.

14. Apparatus according to claim 6, further comprising:

means for also applying to said first clock generator a control voltage having a smooth non-sinusoidal waveform of frequency in the range of about 3 to 7 Hz and of predetermined amplitude, and means for also applying to said second clock generator a control voltage of smooth non-sinusoidal waveform having the same frequency as that applied to said first clock generator and phase displaced relative thereto by a predetermined phase angle in the range from 0° to 180°.

* * * * *